US009182713B2

(12) United States Patent
Narahara et al.

(10) Patent No.: US 9,182,713 B2
(45) Date of Patent: Nov. 10, 2015

(54) FIXING APPARATUS

(71) Applicant: CANON KABUSHIKI KAISHA, Tokyo (JP)

(72) Inventors: Takashi Narahara, Mishima (JP); Toru Imaizumi, Kawasaki (JP); Takanori Watanabe, Kawasaki (JP); Masahiko Suzumi, Yokohama (JP); Kazuhiro Doda, Yokohama (JP); Takanori Mitani, Tokyo (JP); Kazuaki Takahata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/355,527

(22) PCT Filed: Nov. 2, 2012

(86) PCT No.: PCT/JP2012/007040
§ 371 (c)(1),
(2) Date: Apr. 30, 2014

(87) PCT Pub. No.: WO2013/065317
PCT Pub. Date: May 10, 2013

(65) Prior Publication Data

US 2014/0308052 A1 Oct. 16, 2014

(30) Foreign Application Priority Data

Nov. 4, 2011 (JP) ..... 2011-242512

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/90, 88, 334, 335, 338
See application file for complete search history.

(56) References Cited

U.S. PATENT DOCUMENTS

| | | | | |
|---|---|---|---|---|
| 5,362,943 | A * | 11/1994 | Sakata | 219/216 |
| 5,506,667 | A * | 4/1996 | Kinoshita | 399/21 |
| 5,932,125 | A * | 8/1999 | Kawata et al. | 219/216 |
| 8,606,163 | B2 * | 12/2013 | Yamamoto et al. | 399/329 |
| 2009/0169231 | A1 * | 7/2009 | Asakura et al. | 399/69 |
| 2011/0116850 | A1 | 5/2011 | Lee et al. | |
| 2011/0129267 | A1 * | 6/2011 | Arimoto et al. | 399/329 |

(Continued)

FOREIGN PATENT DOCUMENTS

| | | | |
|---|---|---|---|
| CN | 102023550 | A | 4/2011 |
| JP | 8-36318 | A | 2/1996 |

(Continued)

*Primary Examiner* — Rodney Bonnette
(74) *Attorney, Agent, or Firm* — Canon USA Inc. IP Division

(57) ABSTRACT

In one aspect of the invention, a fixing apparatus that heats a recording material having a toner image while conveying the recording material at a nip portion to make the toner image fix onto the recording material includes a cylindrical belt having a heat generating layer that generates heat by being energized and a contact for supplying electricity to the heat generating layer. The contact is in contact with one of an outer surface and an inner surface of an end of the belt in the generatrix direction of the belt. An electrically conductive layer is provided, along the direction of rotation of the belt, on a surface of the heat generating layer opposite to a surface of the heat generating layer at which the contact is present.

17 Claims, 7 Drawing Sheets

(56) References Cited

U.S. PATENT DOCUMENTS

| | | | | |
|---|---|---|---|---|
| 2011/0150545 | A1* | 6/2011 | Nihonyanagi et al. | 399/329 |
| 2012/0155912 | A1* | 6/2012 | Hayase et al. | 399/90 |
| 2013/0064587 | A1* | 3/2013 | Jeong et al. | 399/329 |

FOREIGN PATENT DOCUMENTS

| | | | |
|---|---|---|---|
| JP | 9-197881 | A | 7/1997 |
| JP | 10-142982 | A | 5/1998 |
| JP | 10-199658 | A | 7/1998 |
| JP | 2000-147933 | A | 5/2000 |
| JP | 2001-65005 | A | 3/2001 |
| JP | 2002-296941 | A | 10/2002 |
| JP | 2003-057984 | A | 2/2003 |
| JP | 2004-279796 | A | 10/2004 |
| JP | 2007-272223 | A | 10/2007 |
| JP | 2008-268354 | A | 11/2008 |
| JP | 2009-92785 | A | 4/2009 |
| JP | 2009-109997 | A | 5/2009 |
| JP | 2011-118093 | A | 6/2011 |
| JP | 2011-145656 | A | 7/2011 |

* cited by examiner

FIXING APPARATUS

TECHNICAL FIELD

The present invention relates to a fixing apparatus that is to be mounted in an electrophotographic image forming apparatus such as a copying machine or a printer.

BACKGROUND ART

As a fixing apparatus of an image forming apparatus such as a copying machine or a laser printer, PTL 1 discloses a fixing apparatus employing a method of making a toner image on a recording material fix onto the recording material by supplying electricity to a heat generating layer provided on a belt and causing the belt itself to generate heat. A fixing apparatus employing such a method reaches a state of being able to perform fixing in a short time after the fixing apparatus is powered on and has an advantage of speeding up of start-up.

A problem of a fixing apparatus employing a belt which has a heat generating layer will be described with reference to FIG. 12A and FIG. 12B. In FIG. 12A, electrodes 5*a* and 5*b* for energizing are in contact with ends of a belt 1 in the direction perpendicular to the direction of rotation of the belt 1, and the belt 1 is energized by an AC power supply V via the electrodes 5*a* and 5*b* so as to generate heat. In this case, the current density of the flowing current reaches the highest value in an area of a straight line connecting the electrodes 5*a* and 5*b*, and the amount of heat generation also reaches the highest value in the same area. Because of this, the amount of heat generation becomes high in the area of the straight line connecting the electrodes 5*a* and 5*b* and becomes low in areas far from the area of the straight line connecting the electrodes 5*a* and 5*b*, and as a result, heat is unevenly generated in the direction of rotation of the belt 1.

To eliminate the unevenness in heat generation in the direction of rotation of the belt 1, for example, as shown in FIG. 12B, electrically conductive layers 4*a* and 4*b* are provided at the ends of the belt 1 to make the current flow throughout the belt 1. PTL 1 discloses a configuration in which electrically conductive layers are provided at ends of an outermost layer of a belt and extend along the outermost layer in the direction of rotation of the belt, and in which power supplying rollers or electrode brushes are placed so as to be in contact with the electrically conductive layers to supply electricity to the electrically conductive layers. Having such a configuration enables the current to uniformly flow throughout the belt 1, and as a result, the unevenness in heat generation in the direction of rotation of the belt 1 can be eliminated.

However, since the electrically conductive layer is formed by applying or bonding a conductive ink, a conductive paste, a metallic foil, a metallic mesh or the like to the belt, if the electrically conductive layer slides while being in contact with an electrode portion, the electrically conductive layer may sometimes be scraped with long-term use. This results in unevenness in heat generation, and thus there is a problem that unevenness in heat generation cannot be suppressed for long periods of time.

CITATION LIST

Patent Literature

PTL 1: Japanese Patent Laid-Open No. 2007-272223

SUMMARY OF INVENTION

The present invention provides a fixing apparatus that causes a belt to generate heat by energizing the belt and suppresses unevenness in heat generation in the direction of rotation of the belt for long periods of time.

In a first aspect of the invention, a fixing apparatus that fixes a toner image on a recording material while conveying the recording material bearing the toner image at a nip portion includes a cylindrical belt having a heat generating layer that generates heat by being energized and a contact for supplying power to the heat generating layer. The contact is in contact with one of an outer surface and an inner surface of an end of the belt in a generatrix direction of the belt. An electrically conductive layer is provided, along the direction of rotation of the belt, on a surface of the heat generating layer opposite to a surface of the heat generating layer at which the contact is present.

In a second aspect of the invention, a fixing apparatus that fixes a toner image on a recording material while conveying the recording material bearing the toner image at a nip portion includes a cylindrical belt having a heat generating layer which generates heat by being energized and a contact that supplies power to the heat generating layer by being in contact with the belt. The belt has an electrically conductive layer that is provided so as to oppose the contact across the heat generating layer.

In a third aspect of the invention, a cylindrical belt used in a fixing apparatus that fixes a toner image on a recoding material while conveying the recording material bearing the toner image at a nip portion includes a heat generating layer that generates heat by being energized and an electrically conductive layer which is provided, along the direction of rotation of the belt, on a surface of the heat generating layer opposite to a contacting portion on the belt to be in contact with a contact for supplying power to the heat generating layer.

DESCRIPTION OF EMBODIMENTS

First Embodiment

Figure 1A:
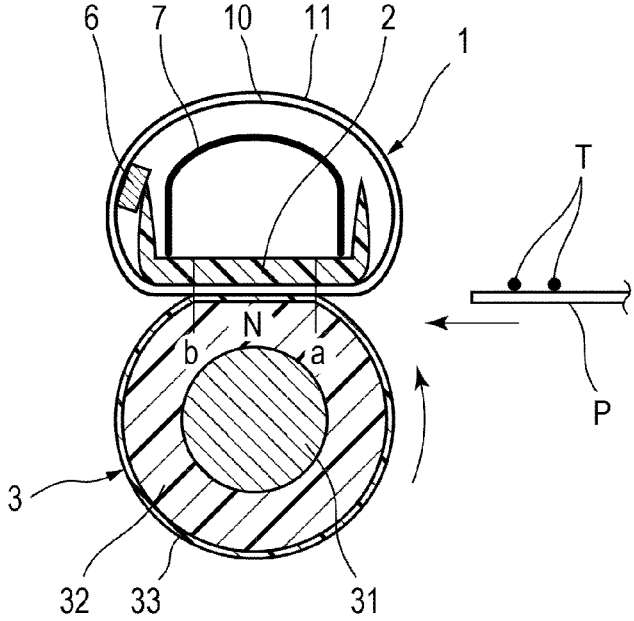
FIG. 1A is a cross-sectional view of a fixing apparatus according to a first embodiment along a plane orthogonal to the direction perpendicular to the direction of rotation of a belt.
Figure 1B:
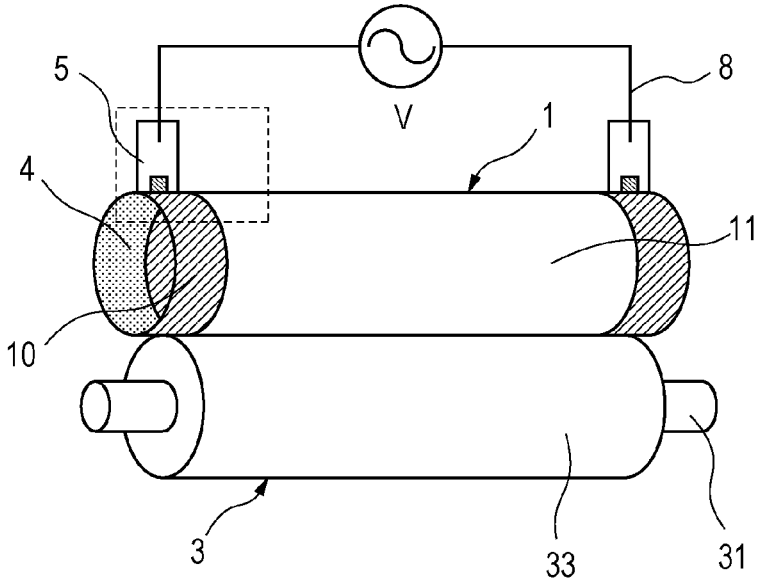
FIG. 1B is a diagram showing a configuration of the fixing apparatus in the direction perpendicular to the direction of rotation of the belt.

A configuration of a fixing apparatus according to a first embodiment will be described with reference to FIG. 1A and FIG. 1B. FIG. 1A is a cross-sectional view of the fixing apparatus along a plane orthogonal to the direction perpendicular to the direction of rotation of a cylindrical belt 1. FIG. 1B is a schematic diagram showing a configuration of the fixing apparatus in the direction perpendicular to the direction of rotation of the belt 1. Note that the direction perpendicular to the direction of rotation of the belt 1 is the same as the generatrix direction of the belt 1.

The fixing apparatus according to the first embodiment that employs a method of making a belt generate heat includes a cylindrical belt 1, a belt guiding member 2 that holds the belt 1, and a pressure roller 3 serving as a pressure member that forms a nip portion N in conjunction with the belt 1.

From the right side of FIG. 1A, a recording material P having a toner image T is heated while being conveyed at the nip portion N, and the toner image T is fixed onto the recording material P.

The belt 1 has a heat generating layer 10 as a base layer and has a three-layer structure of the base layer, an intermediate layer (not shown), and a covering layer 11. The heat generating layer 10 is a layer that generates heat by being energized and also has mechanical properties such as that provide the belt 1 with torsional strength and smoothness. The heat generating layer 10 is formed by dispersing an electrically conductive filler such as carbon in a resin such as polyimide. The electric resistance of the heat generating layer 10 is adjusted so that the heat generating layer 10 generates heat by being energized by an AC power supply. The intermediate layer (not shown) serves as an adhesive that bonds the covering layer 11 and the heat generating layer 10 together. In the first embodiment, the covering layer 11 is used as a surface layer. Therefore, the covering layer 11 is made of PFA (perfluoroalkoxy fluoroplastics) or PTFE (polytetrafluoroethylene) that has a good releasability. The intermediate layer (not shown) and the covering layer 11 are not present at both ends of the belt 1 in the direction perpendicular to the direction of rotation of the belt 1, and the heat generating layer 10 is exposed so that the heat generating layer 10 can be supplied with electricity from an outer surface thereof.

The belt guiding member 2 is made of a heat-resistant resin such as a liquid crystal polymer, PPS (polyphenylene sulfide resin), or PEEK (polyether ether ketone). Both ends of the belt guiding member 2 in the direction perpendicular to the direction of rotation of the belt 1 are engaged with a reinforcing stay 7 that is held by an apparatus frame. In addition, both ends of the reinforcing stay 7 in the direction perpendicular to the direction of rotation of the belt 1 are urged by urging unit (not shown) so that the belt guiding member 2 is pressed against the pressure roller 3 with the belt 1 therebetween. The reinforcing stay 7 is made of a rigid material such as iron, stainless steel, or a zinc-coated steel sheet in order to uniformly deliver the urging pressure received at both ends of the reinforcing stay 7 to the belt guiding member 2 in the direction perpendicular to the direction of rotation of the belt 1. Furthermore, the reinforcing stay 7 has a cross-sectional shape by which a large geometrical moment of inertia is obtained (a U-shape), thereby having a high bending rigidity.

By suppressing the deflection of the belt guiding member 2 in this way, the width of the nip portion N in the direction of rotation of the belt 1 (a distance between a and b in FIG. 1A) is approximately uniform in the direction perpendicular to the direction of rotation of the belt 1. A temperature detecting element 6 is provided on the belt guiding member 2 and is in contact with an inner face of the belt 1. Energization of the heat generating layer 10 is controlled so that the temperature detected by the temperature detecting element 6 becomes a target temperature at which the toner image T can be fixed on the recording material P.

In the first embodiment, a liquid crystal polymer is used as a material of the belt guiding member 2, and a zinc-coated steel sheet is used as a material of the reinforcing stay 7. The pressing force applied to the pressure roller 3 is 160 N, and in this case, the width of the nip portion N in the direction of rotation of the belt 1 (the distance between a and b in FIG. 1A) is 6 mm.

The pressure roller 3 includes a cored bar 31 made of a material such as iron or aluminum, an elastic layer 32 made of a material such as silicone rubber, and a release layer 33 made of a material such as PFA. The hardness of the pressure roller 3 may be in the range of 40 to 70 degrees when being measured with an Asker C durometer under a load of 1 kgf in order to allow the nip portion N to provide satisfactory fixability and in order to obtain satisfactory durability.

In the first embodiment, a silicone rubber layer having a thickness of 3.5 mm is formed on an iron cored bar having an outside diameter of 11 mm, and the silicone rubber layer is covered with an insulating PFA tube having a thickness of 40 micrometers. The hardness of the pressure roller 3 is 56 degrees, and an outside diameter thereof is 18 mm. The length of an elastic layer and the length of a release layer in the direction perpendicular to the direction of rotation of the belt 1 are 226 mm.

As shown in FIG. 1B, AC cables 8 that are connected to an AC power supply V are connected to contacts 5. The contacts 5 are in contact with the exposed portions of the outer surface of the heat generating layer 10. A brush formed of a bundle of thin gold wires or the like, a plate-like spring, a pad, or the like is used as each contact 5.

Next, a characteristic configuration of the first embodiment will be described in detail. The heat generating layer 10 is made of a polyimide resin and has a thickness of 50 micrometers, an outside diameter of 18 mm, and a length of 240 mm in the direction perpendicular to the direction of rotation of the belt 1. As an electrically conductive filler, carbon black is dispersed in the polyimide resin which forms the heat generating layer 10. In addition, the covering layer 11 is provided on the outer surface of the heat generating layer 10. Since the covering layer 11 is used as a release layer in the first embodiment, the covering layer 11 is made of PFA and has a thickness of 15 micrometers.

Each of the exposed portions of the heat generating layer 10 at the ends of the belt 1 in the direction perpendicular to the direction of rotation of the belt 1 has a length of 10 mm. In addition, electrically conductive layers 4 are provided at ends on rear faces of the exposed portions of the heat generating layer 10 (faces of the heat generating layer 10 opposite to faces of the heat generating layer 10 with which the contacts 5 are in contact) for a length of 12 mm. The electrically conductive layers 4 are formed by coating the entire ends in the direction of rotation of the belt 1 with a silver paste. A surface resistance of each of the electrically conductive layers 4 is smaller than that of the heat generating layer 10.

The actual resistance between the contacts 5 (the length of 240 mm) on the belt 1 in the direction perpendicular to the direction of rotation of the belt 1 is 20 ohms, and the actual resistance between each of the contacts 5 and the corresponding one of the electrically conductive layers 4 in the direction of thickness of the belt 1 is 1.8 ohms.

Note that when the electrically conductive layers 4 are not formed, the actual resistance between the contacts 5 on the belt 1 in the direction perpendicular to the direction of rotation of the belt 1 is 42 ohms, and thus it is found that a current easily flows from the contacts 5 to the heat generating layer 10 in the direction of rotation of the belt 1 via the electrically conductive layers 4.

In order to make the electrically conductive layers 4 and the heat generating layer 10 easily bond together, an electrically conductive intermediate layer (not shown) may be provided between the electrically conductive layers 4 and the heat generating layer 10.

A carbon tip and a plate-like spring made of stainless steel are used to form each contact 5. The carbon tip is pressed against the exposed portion of the outer surface of the heat generating layer 10 by the urging pressure of the plate-like spring.

Note that the above-described configuration is based on the assumption that the voltage of the AC power supply is 100 V.

Figure 2:
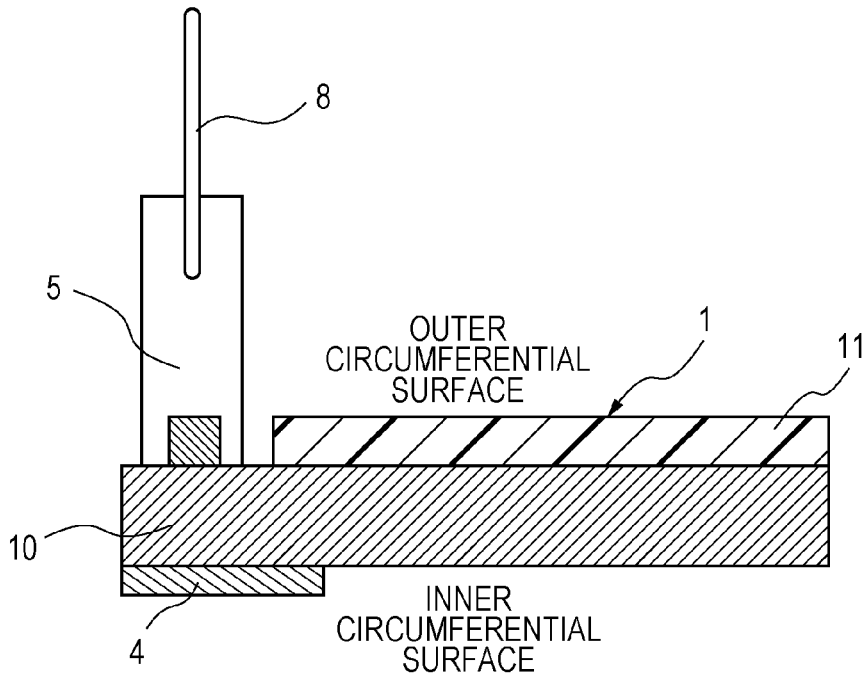
FIG. 2 is a cross-sectional view of a portion shown by a dashed line in FIG. 1B.

Next, FIG. 2 illustrates a cross-sectional view of a portion shown by a dashed line in FIG. 1B. In the first embodiment, at an end of the belt 1, at least a part of the area on the belt 1 to be in contact with the contact 5 (the carbon tip) overlaps with the electrically conductive layer 4 in the generatrix direction of the belt 1. The area on the belt 1 to be in contact with the contact 5 is a contacting portion.

Next, advantageous effects of the first embodiment will be described. The unevenness in heat generation in the direction of rotation of the belt 1 can be suppressed because the electrically conductive layers 4 are provided at ends of the heat generating layer 10 and extend along the heat generating layer 10 in the direction of rotation of the belt 1. Therefore, the current flows from the contacts 5 in the direction of thickness of the heat generating layer 10 to the electrically conductive layers 4 and then flows to the heat generating layer 10. Thus the current is likely to uniformly flow also in the direction of rotation of the belt 1. Furthermore, since there is no sliding contact between the contacts 5 and the electrically conductive layers 4, the electrically conductive layers 4 will not be scraped, and the unevenness in heat generation of the belt 1 in the direction of rotation of the belt 1 can be suppressed even with the long-term use of the fixing apparatus.

Figure 3:
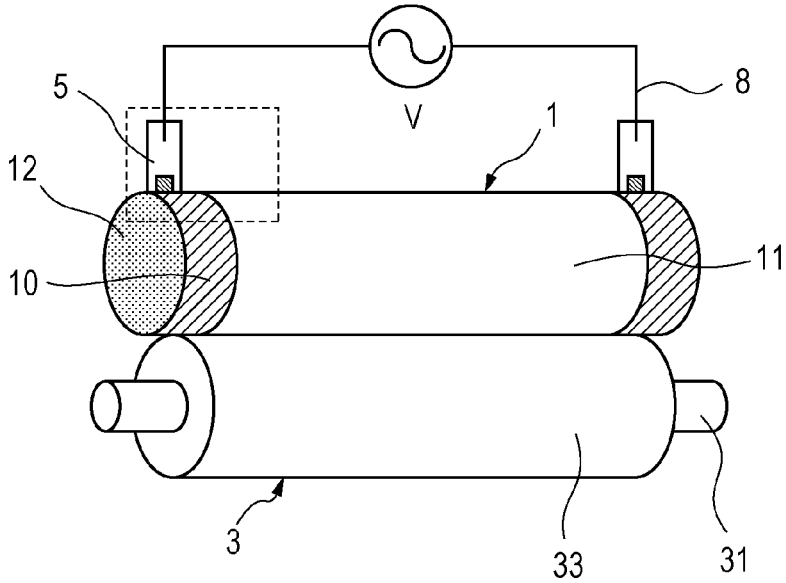
FIG. 3 is a diagram showing a configuration of a fixing apparatus according to a modification of the first embodiment in the direction perpendicular to the direction of rotation of a belt.
Figure 4:
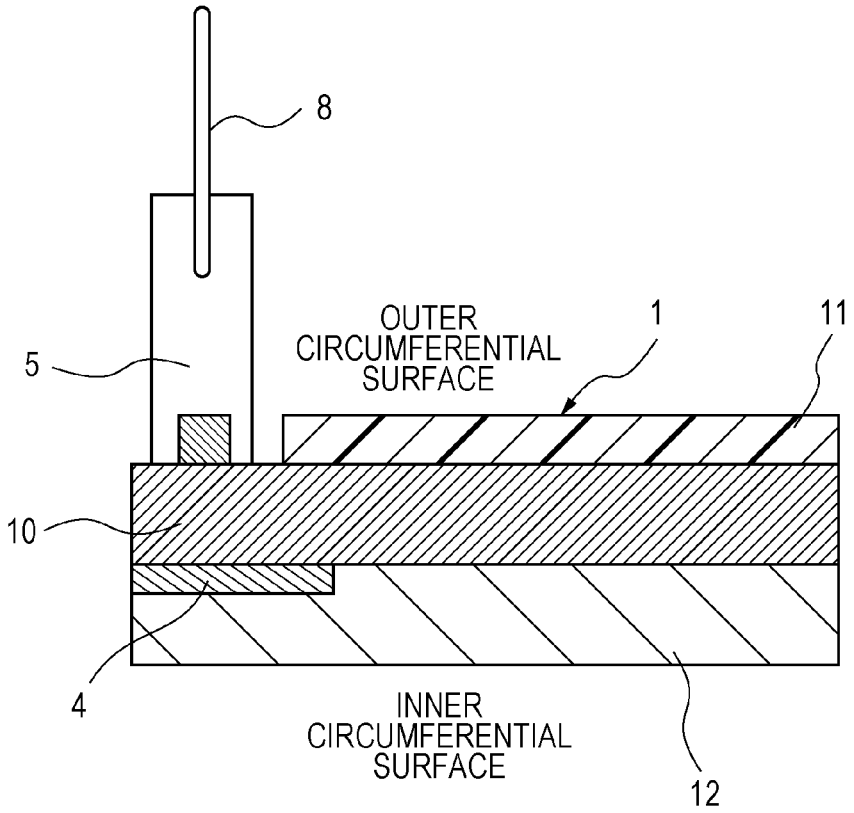
FIG. 4 is a cross-sectional view of a portion shown by a dashed line in FIG. 3.

As a modification of the first embodiment, a base layer 12 made of a polyimide resin may be formed on an inner surface of the heat generating layer 10 of the belt 1 according to the first embodiment, as shown in FIG. 3 and FIG. 4. Since priority is given to mechanical properties such as torsional strength and smoothness, only a little amount of the electrically conductive filler is added to the base layer 12. Therefore, when the contacts 5 are energized, a surface resistance of the base layer 12 is a few kohms per square, which is a high value, and the base layer 12 will not generate heat because the current will not flow to the base layer 12. The thickness of the base layer 12 is 60 micrometers. Since the electrically conductive layers 4 formed on the inner surface of the heat generating layer 10 are covered with the base layer 12, the electrically conductive layers 4 will not slide while being in contact with any of the members located on the inner surface side of the belt 1.

The above leads to the fact that the above-described modification has advantageous effects in that the belt 1 thereof has better mechanical properties than those of the belt 1 according to the first embodiment, and that the electrically conductive layers 4 are less likely to be scraped.

Second Embodiment

Figure 5A:
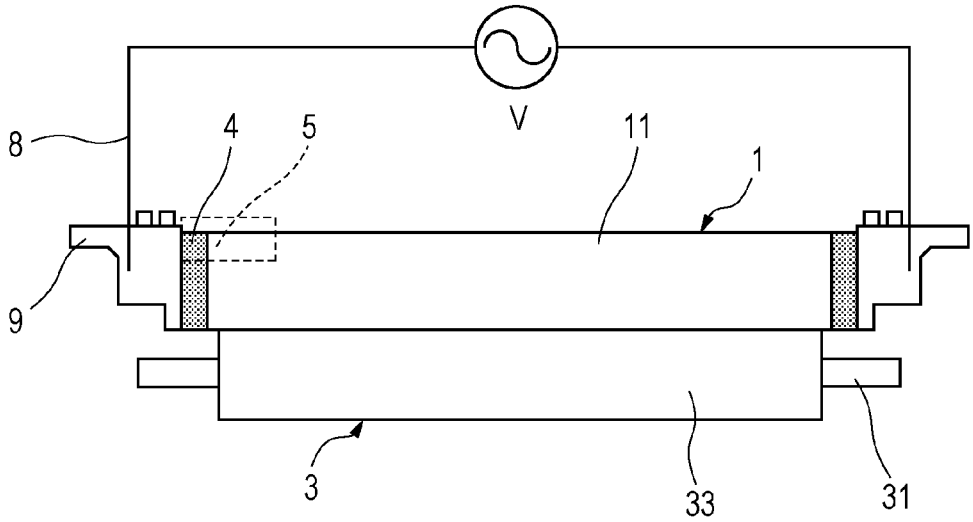
FIG. 5A is a diagram showing a configuration of a fixing apparatus according to a second embodiment in the direction perpendicular to the direction of rotation of a belt.

A configuration of a fixing apparatus according to a second embodiment will be described with reference to FIG. 5A and FIG. 5B. Descriptions of a configuration which is the same as that of the first embodiment will be avoided.

Features of the configuration of the second embodiment will be described. FIG. 5A is a schematic diagram showing the configuration of the fixing apparatus in the direction perpendicular to the direction of rotation of a belt 1. FIG. 5B is a schematic diagram of one of flanges 9 for controlling movement of the belt 1 in the direction perpendicular to the direction of rotation of the belt 1. FIG. 6 illustrates a cross-sectional view of a portion shown by a dashed line in FIG. 5A.

Figure 5B:
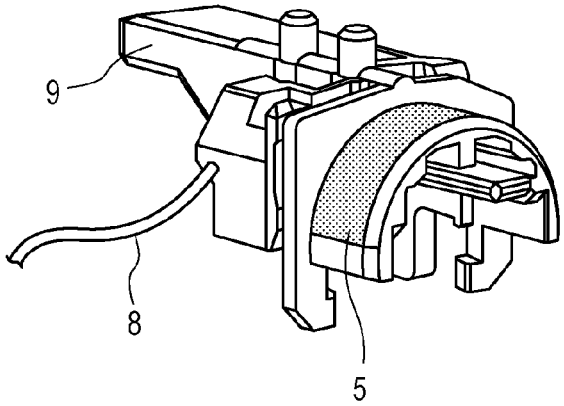
FIG. 5B is a schematic diagram of a flange according to the second embodiment.
Figure 6:
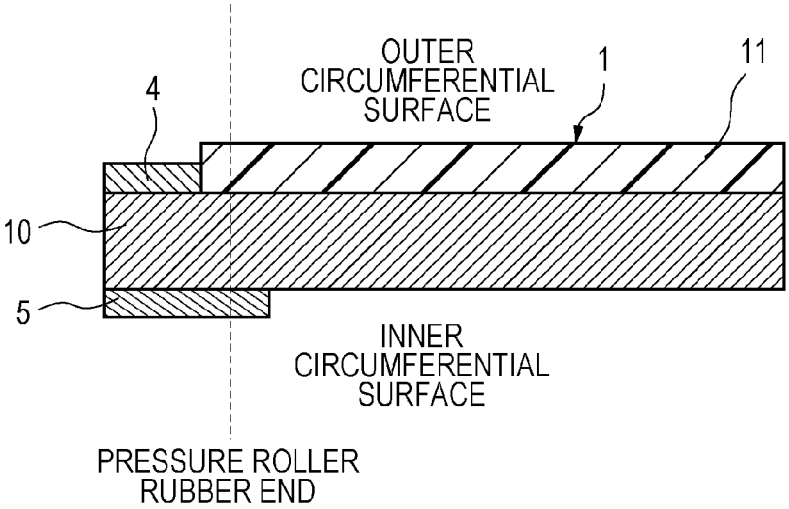
FIG. 6 is a cross-sectional view of a portion shown by a dashed line in FIG. 5A.

As shown in FIG. 5B, stainless steel sheets serving as contacts 5 are provided on faces of the flanges 9 that have a sliding contact with an inner surface of the belt 1. An alternating voltage is applied from an AC power supply V to the sheets through AC cables 8. As shown in FIG. 6, each of the contacts 5 supplies electricity to a heat generating layer 10 by being in contact with an inner surface of a corresponding end of the heat generating layer 10 in the direction perpendicular to the direction of rotation of the belt 1.

Electrically conductive layers 4 are formed on an outer surface of the belt 1 at the ends thereof in the direction perpendicular to the direction of rotation of the belt 1. A current flows from the contacts 5 in the direction of thickness of the heat generating layer 10 to the electrically conductive layers 4 and then flows to the heat generating layer 10.

In the second embodiment, a covering layer 11 is provided on a portion located inside between the electrically conductive layers 4 in the direction perpendicular to the direction of rotation of the belt 1. The covering layer 11 is formed by a coating process using PFA and has a thickness of about 15 micrometers. One of end faces of a rubber layer of a pressure roller 3 in the direction perpendicular to the direction of rotation of the belt 1 is located at a position shown by a dashed line in FIG. 6. Since the electrically conductive layers 4 are formed outside of the end faces of the pressure roller 3 in the direction perpendicular to the direction of rotation of the belt 1, the electrically conductive layers 4 will not slide while being in contact with the pressure roller 3 or any other members.

In addition to the advantageous effects of the first embodiment, in the second embodiment, a power supplying portion can be arranged in smaller space by providing the contacts 5 on the flanges 9.

Third Embodiment

A configuration of a fixing apparatus according to a third embodiment will be described with reference to FIG. 7 and FIG. 8. Descriptions of a configuration which is the same as those of the first embodiment and the second embodiment will be avoided.

Figure 7:
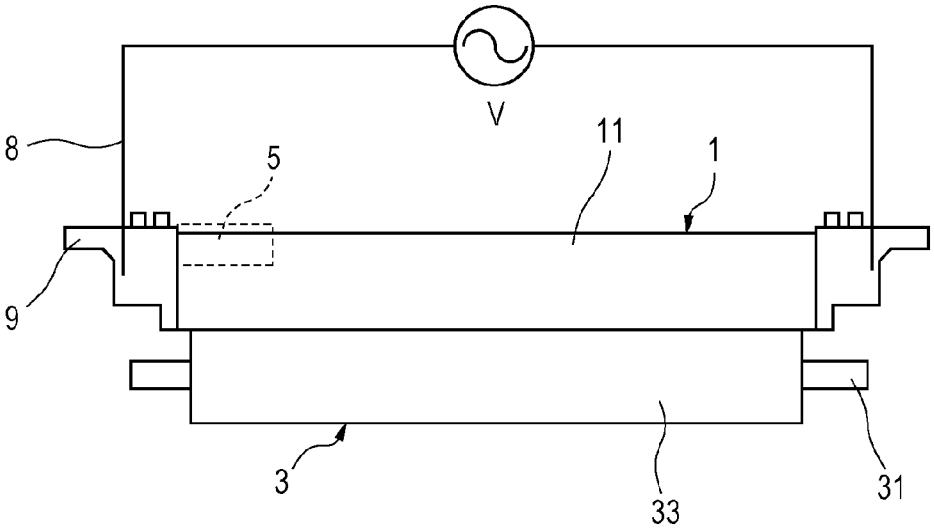
FIG. 7 is a diagram showing a configuration of a fixing apparatus according to a third embodiment in the direction perpendicular to the direction of rotation of a belt.

FIG. 7 is a schematic diagram showing the configuration of the fixing apparatus in the direction perpendicular to the direction of rotation of a belt 1. FIG. 8 is a cross-sectional view of a portion shown by a dashed line in FIG. 7.

The configuration of the third embodiment is the same as that of the second embodiment except for the following. As shown in FIG. 8, a difference from the second embodiment is that electrically conductive layers 4 that are provided on an outer surface of a heat generating layer 10 are covered with a covering layer 11. The covering layer 11 is formed by a coating process using PFA and has a thickness of about 15 micrometers. The covering layer 11 is used as a release layer.

Since the electrically conductive layers 4 are covered with the covering layer 11, the electrically conductive layers 4 are less likely to be scraped even in the case of being in contact with a pressure roller 3. Therefore, the third embodiment has an advantage that the length of the belt 1 in the direction perpendicular to the direction of rotation of the belt 1 can be shorter than that of the second embodiment.

Note that the covering layer 11 is not necessarily a release layer as long as it covers the electrically conductive layers 4. A release layer may be provided on an outer surface of the covering layer 11.

Figure 8:
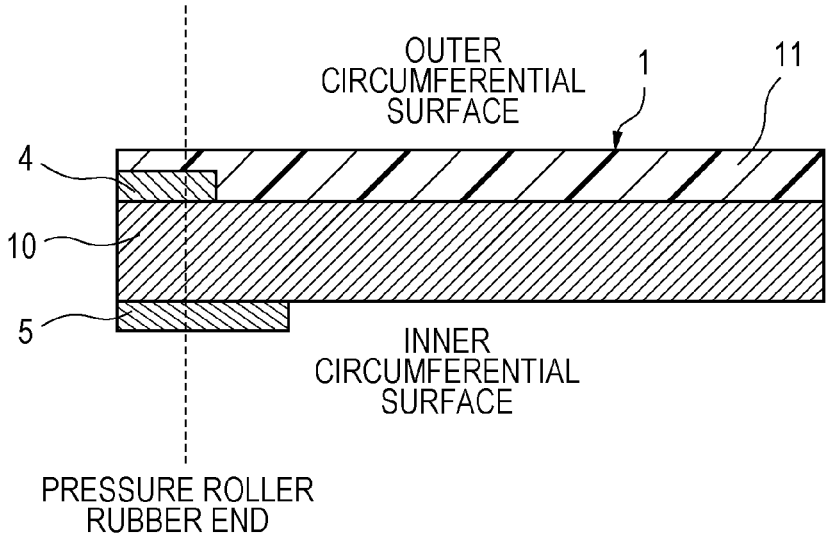
FIG. 8 is a cross-sectional view of a portion shown by a dashed line in FIG. 7.

In the third embodiment, one of end faces of a rubber layer of a pressure roller 3 in the direction perpendicular to the direction of rotation of the belt 1 is located at a position shown by a dashed line in FIG. 8, and the length of the belt 1 became 10 mm shorter than that of the second embodiment. In addition to the advantageous effects of the second embodiment, the third embodiment has an advantage that the fixing apparatus can be further downsized.

Fourth Embodiment

A configuration of a fixing apparatus according to a fourth embodiment will be described with reference to FIG. 9 and FIG. 10. Descriptions of a configuration which is the same as those of the first to third embodiments will be avoided.

Figure 9:
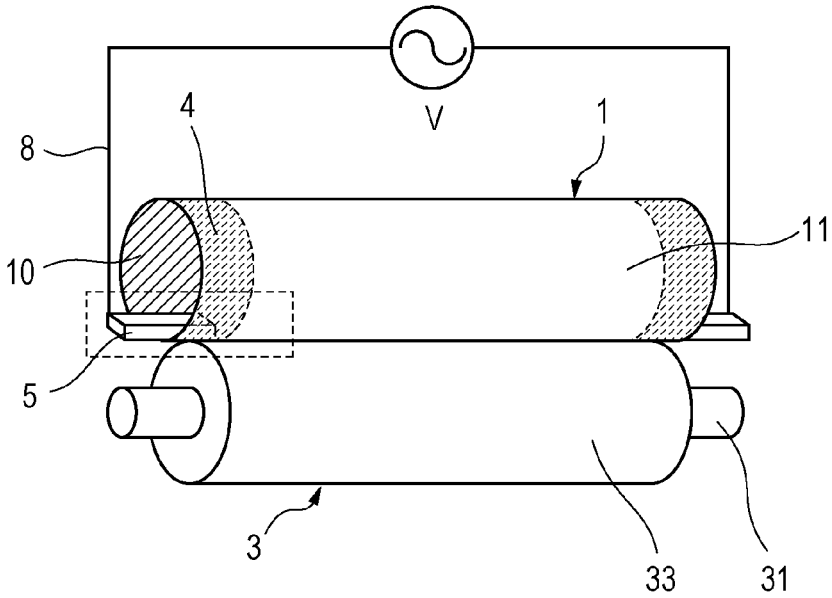
FIG. 9 is a diagram showing a configuration of a fixing apparatus according to a fourth embodiment in the direction perpendicular to the direction of rotation of a belt.
Figure 10:
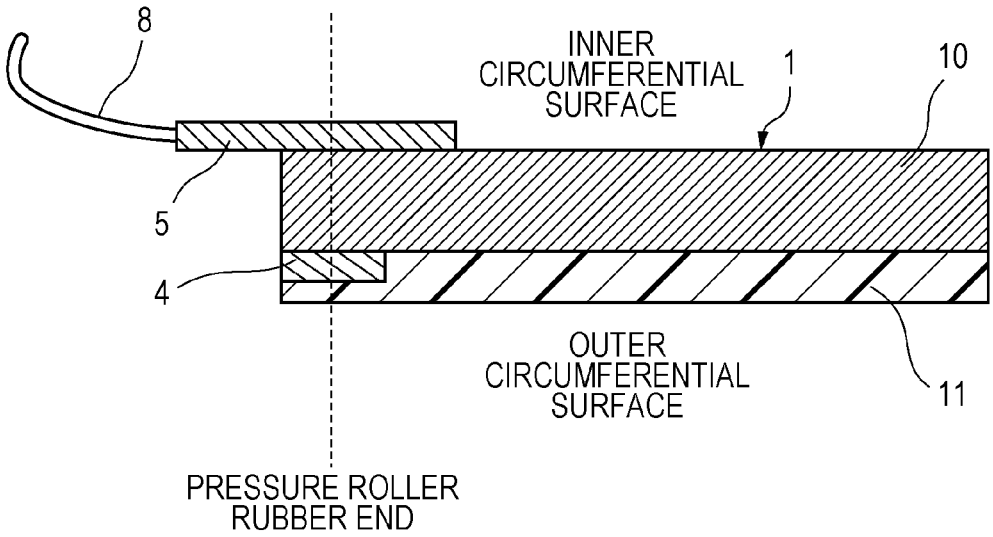
FIG. 10 is a cross-sectional view of a portion shown by a dashed line in FIG. 9.

FIG. 9 is a schematic diagram showing the configuration of the fixing apparatus in the direction perpendicular to the direction of rotation of a belt 1. FIG. 10 is a cross-sectional view of a portion shown by a dashed line in FIG. 9.

The configuration of the fourth embodiment is the same as that of the third embodiment except for the following. A difference from the third embodiment is that contacts 5 are disposed at ends of a nip portion in the direction perpendicular to the direction of rotation of the belt 1.

In the fourth embodiment, sheet metals made of stainless steel are used as the contacts 5. AC cables 8 are connected to the stainless steel sheet metals each of which has a thickness of 1 mm, and an alternating voltage is supplied from an AC power supply V to the stainless steel sheet metals so that the stainless steel sheet metals supply electricity to a heat generating layer 10. The contacts 5 are pressed against a rubber layer of a pressure roller 3 with the belt 1 therebetween. Each of the contacts 5 has a width of 5 mm in the direction perpendicular to the generatrix direction of the belt 1. In addition, each of the contacts 5 is nipped 5 mm at a corresponding end of the nip portion in the generatrix direction of the belt 1.

In the configuration of the fourth embodiment, the variation in a contact area between the contacts 5 and the heat generating layer 10 is smaller than that in the configuration of the first embodiment, in which the heat generating layer 10 is supplied with electricity from the outer surface of the belt 1 and that in the configuration of the second and third embodiments, in which the heat generating layer 10 is supplied with electricity from the inner surface of the belt 1 by the contacts 5 provided on portions of the flanges 9. Therefore, the current density in a power supplying portion becomes adequate, and an excessive heat generation can be suppressed.

Note that in the first to fourth embodiments, the advantageous effects of the present invention can be obtained as long as the contacts are in contact with one of the outer surface and the inner surface of the belt at the ends thereof, and as long as the electrically conductive layers are formed at least on the surface of the heat generating layer opposite to the surface of the heat generating layer at which the contacts are present. Therefore, the electrically conductive layers may be formed on the outer surface and the inner surface of the heat generating layer. This is because when there are electrically conductive layers on both surfaces of the heat generating layer, the electrically conductive layers which are formed on the surface of the heat generating layer opposite to the surface of the heat generating layer at which the contacts are present will not be scraped even if the electrically conductive layers which are in contact with the contacts are scraped due to sliding contact with the contacts, and thus the effect of suppressing the unevenness in heat generation will be maintained.

In an image forming apparatus that forms color images, providing an elastic layer on a belt provides a good followability with papers and prevents gloss unevenness, resulting in improvement of image quality.

Figure 11:
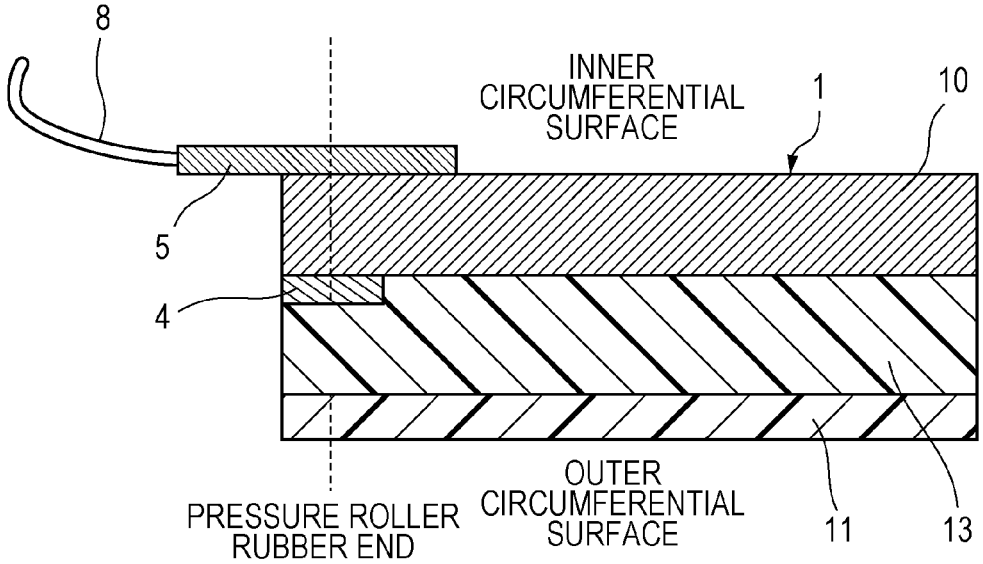
FIG. 11 is a cross-sectional view of a power supplying portion with an elastic layer provided on the belt according to the fourth embodiment.
Figure 12A:
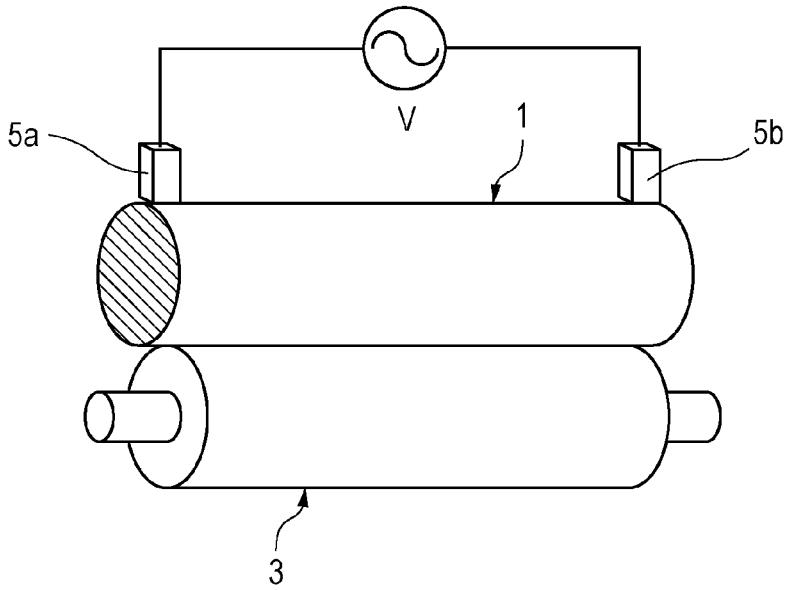
FIG. 12A is a diagram showing a configuration of a fixing apparatus employing a belt having a heat generating layer of the related art in the direction perpendicular to the direction of rotation of the belt.
Figure 12B:
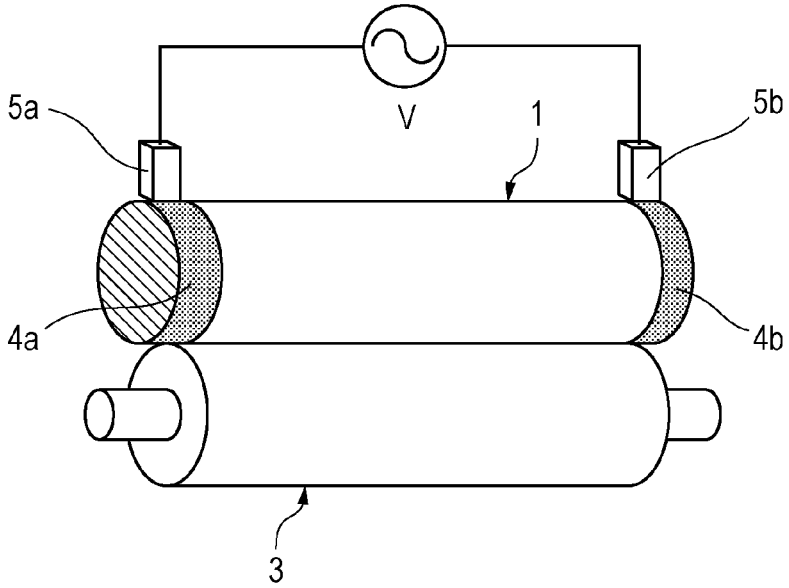
FIG. 12B is a diagram showing the configuration of the fixing apparatus employing a belt having a heat generating layer of the related art in the direction perpendicular to the direction of rotation of the belt.

Although the configuration in which the heat generating layer of the belt is covered with the covering layer is shown in the first to fourth embodiments, an elastic layer may be interposed between the heat generating layer and the covering layer. FIG. 11 shows a cross-sectional view of a power supplying portion with an elastic layer 13 provided on a belt 1 according to the configuration of the fourth embodiment. As the elastic layer 13, silicone rubber is applied to a thickness of 150 micrometers. There may sometimes be intermediate layers (not shown) each of which serves as an adhesive between the heat generating layer 10 and the elastic layer 13 and between the elastic layer 13 and the covering layer 11. The advantageous effects of the fourth embodiment can be obtained even if the belt 1 has such a configuration as that shown in FIG. 11 in the fourth embodiment. It is obvious that the configurations of the first to third embodiments can also include the elastic layer 13 as shown in the fourth embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-242512, filed Nov. 4, 2011, which is hereby incorporated by reference herein in its entirety.

The invention claimed is:

1. A fixing apparatus that fixes a toner image on a recording material while conveying the recording material bearing the toner image at a nip portion, the fixing apparatus comprising:

a cylindrical belt including a heat generating layer that generates heat by being energized; and a contact for supplying power to the heat generating layer, the contact being in contact with one of an outer surface and an inner surface of an end of the belt in a generatrix direction of the belt, wherein an electrically conductive layer is provided, along a direction of rotation of the belt, on a surface of the heat generating layer opposite to a surface of the heat generating layer at which the contact is present, and wherein a surface resistance (ohms per square) of the electrically conductive layer is smaller than a surface resistance (ohms per square) of the heat generating layer.

2. The fixing apparatus according to claim 1, wherein at least a part of the area on the belt to be in contact with the contact overlaps with the electrically conductive layer in the generatrix direction of the belt.

3. The fixing apparatus according to claim 1, wherein the contact is in contact with the inner surface of the belt, and wherein the electrically conductive layer is provided on an outer surface of the heat generating layer.

4. The fixing apparatus according to claim 3, wherein a covering layer that covers an outer surface of the electrically conductive layer is provided on the outer surface of the electrically conductive layer.

5. The fixing apparatus according to claim 1, wherein the contact is in contact with the outer surface of the belt, and wherein the electrically conductive layer is provided on an inner surface of the heat generating layer.

6. The fixing apparatus according to claim 5, wherein a covering layer that covers an inner surface of the electrically conductive layer is provided on the inner surface of the electrically conductive layer.

7. The fixing apparatus according to claim 1, further comprising: a nip-portion-forming member that is in contact with the inner surface of the belt; and a pressure member that forms the nip portion together with the nip-portion-forming member via the belt.

8. The fixing apparatus according to claim 1, wherein the belt slides with the contact while rotating.

9. A fixing apparatus that fixes a toner image on a recording material while conveying the recording material bearing the toner image at a nip portion, the fixing apparatus comprising:

a cylindrical belt having a heat generating layer that generates heat by being energized; and a contact that supplies power to the heat generating layer by being in contact with the belt, wherein the belt includes an electrically conductive layer provided so as to oppose the contact across the heat generating layer, and wherein a surface resistance (ohms per square) of the electrically conductive layer is smaller than a surface resistance (ohms per square) of the heat generating layer.

10. The fixing apparatus according to claim 9, wherein the electrically conductive layer is provided, along the direction of rotation of the belt, at an end of the belt in the generatrix direction of the belt.

11. The fixing apparatus according to claim 9, further comprising: a nip-portion-forming member that is in contact with the inner surface of the belt; and a pressure member that forms the nip portion together with the nip-portion-forming member via the belt.

12. The fixing apparatus according to claim 9, wherein the belt slides with the contact while rotating.

13. A cylindrical belt used in a fixing apparatus, the belt comprising:

a heat generating layer that generates heat by being energized, the heat generating layer having an exposed area exposed to outside at least on an end portion of the belt in a generatrix direction of the belt; and an electrically conductive layer provided, along a direction of rotation of the belt, on a surface of the heat generating layer opposite to a surface of the generating layer on which the exposed area is provided, wherein a surface resistance (ohms per square) of the electrically conductive layer is smaller than a surface resistance (ohms per square) of the heat generating layer.

14. The belt according to claim 13, wherein the exposed area is provided on an inner surface of the heat generating layer, and wherein the electrically conductive layer is provided on an outer surface of the heat generating layer.

15. The belt according to claim 14, further comprising:

a covering layer covering an outer surface of the electrically conductive layer.

16. The belt according to claim 13, wherein the exposed area is provided on an outer surface of the heat generating layer, and wherein the electrically conductive layer is provided on an inner surface of the heat generating layer.

17. The fixing apparatus according to claim 16, wherein further comprising:

a covering layer covering an outer surface of generating layer except for the exposed area.

* * * * *